United States Patent [19]

Cannady, Jr. et al.

[11] Patent Number: 4,552,781

[45] Date of Patent: Nov. 12, 1985

[54] METHOD UTILIZING ULTRASONICALLY INDUCED CAVITATION TO IMPREGNATE POROUS SHEET PASSING THROUGH A RESIN BATH

[75] Inventors: Daniel L. Cannady, Jr., Allendale; Gilbert G. Berg, Hampton, both of S.C.; Walter C. Leschek, Monroeville; Joseph F. Meier, Murrysville, both of Pa.

[73] Assignee: Westinghouse Electric Corp., Pittsburgh, Pa.

[21] Appl. No.: 597,869

[22] Filed: Apr. 9, 1984

[51] Int. Cl.[4] ..... B05D 3/12

[52] U.S. Cl. ..... 427/57; 427/373; 427/385.5; 427/386; 427/392; 427/395

[58] Field of Search ..... 427/57, 373, 385.5, 427/386, 395, 392

[56] References Cited

U.S. PATENT DOCUMENTS 4,302,485 11/1981 Last et al. ..... 427/57

*Primary Examiner*—Bernard D. Pianalto

*Attorney, Agent, or Firm*—Daniel P. Cillo

[57] ABSTRACT

A method of impregnating a flexible, porous cellulosic sheet material involves passing the sheet through a low viscosity resin and across the resonant vibrating surface and through a cavitated zone in close proximity to at least one completely immersed ultrasonic wave generator, operating at a frequency and radiated power level effective to provide a combination vibratory pressure on the resin and cavitation effect causing degassing and heating of the resin, followed by passing the impregnated sheet through a drying means.

6 Claims, 1 Drawing Figure

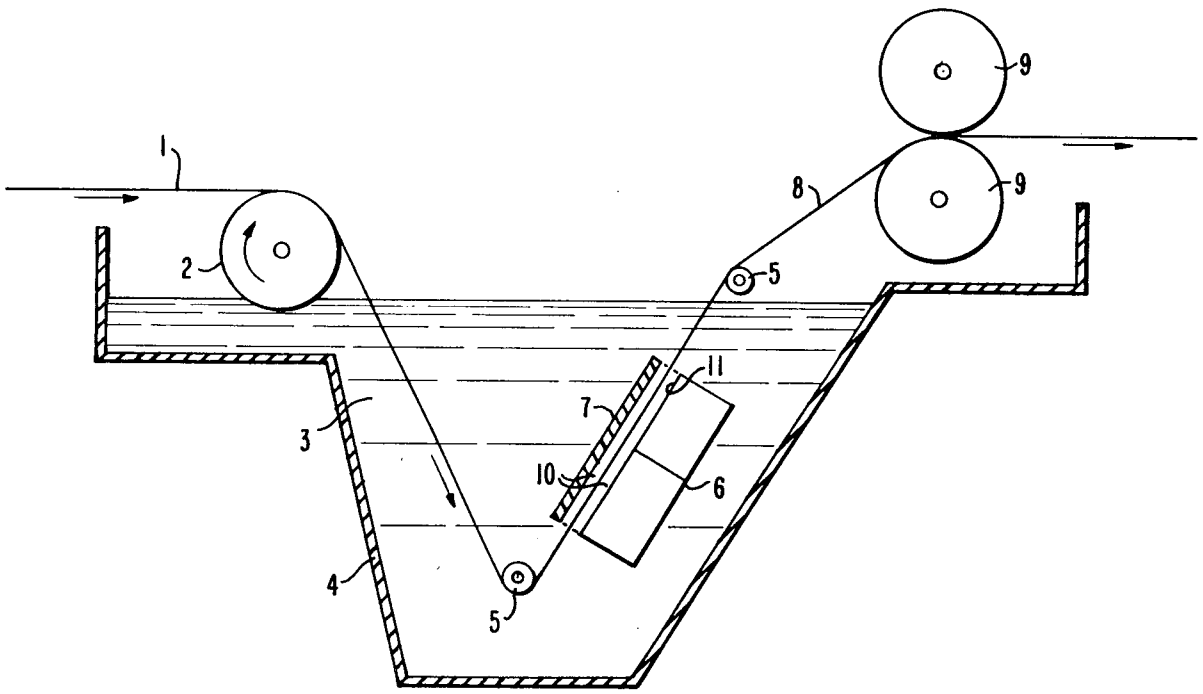
1
2
3
4
5
5
6
7
8
9
9
10
11

METHOD UTILIZING ULTRASONICALLY INDUCED CAVITATION TO IMPREGNATE POROUS SHEET PASSING THROUGH A RESIN BATH

BACKGROUND OF THE INVENTION

Impregnating saturating grade Kraft paper, or alpha-cellulose paper, with phenolic, melamine, epoxy, or polyester resin, for use in making decorative and industrial laminates is well known in the art, and taught, for example, by Alvino et al., in U.S. Pat. No. 4,327,143. Providing a quick, complete, and uniform impregnation of saturating grade Kraft paper, especially if it is a thick, high basis weight type, is a well recognized problem. Incomplete impregnation of the paper in a high speed process results from the high molecular weight of the impregnating resin, and the difficulty of having the resin flow into the pores of the fibrous sheet in a short time period. As the basis weight and caliper of the sheet increases, the difficulties of obtaining uniform, quick impregnation increase.

Both U.S. Pat. No. 4,044,185 and U.S. Pat. No. 3,648,358 describe high pressure decorative laminates. The body or core of the laminate is made of a plurality of phenol-formaldehyde impregnated Kraft paper sheets. It should be apparent that an increase in the thickness of the individual Kraft paper sheets of the core that could be thoroughly impregnated with phenolic resin, could reduce the number of sheets needed in the core. This improved productivity would, of course, require that thorough resin impregnation be obtained at the typical, high constant speed of production resin treaters, above about 500 ft./min.

In the standard method of impregnating laminating paper, described by Alvino et al., referred to above, the fibrous sheet is passed over an initial resin coated roller, to force resin into the sheet pore volume, and then through a resin bath operating at about 25° C. to 30° C. by means of immersed rollers. The travel path through the resin bath is usually from about 8 feet to 10 feet (2.4 to 3 meters), and the dwell time of a differential length of sheet is usually under 0.5 second in commercial operations, since travel rates are usually nominally constant at about 550 feet/minute (167.6 meters/minute). The excess resin is then removed by passing the wet sheet through a set of opposed nip rollers, after which the wet sheet is passed through a long drying oven to "B"-stage the resin. The "B"-staged sheet is then usually cut to appropriate size and can be used in the core of a high pressure laminate.

In order to produce a complete impregnation of thicker, higher basis weight paper, it would be necessary to increase the length of time in the resin bath, as by slowing the sheet travel rate or lengthening the bath, utilizing an immersed heater to increase the temperature of the resin substantially to reduce resin viscosity, or reducing the molecular weight of the resin. However, these solutions provide additional problems. Increasing retention time in the resin bath results in slower line speed, reduced productivity, and increased resin usage. Increasing the temperature is difficult due to buildup of a thermally insulating barrier of cured resin at the surface of the heating element and the eventual loss of heating efficiency. Reducing the molecular weight of the resin results in reduction in product properties and increased loss of resin solids during the subsequent drying operation.

Naundorf et al., in German Democratic Republic Pat. No. 124308, issued Feb. 16, 1977, proposed contacting the impregnating resin bath with one or more ultrasonic generators, and/or attaching one or more ultrasonic generators to the outside steel body of the immersion tank and transmitting the acoustic energy through the steel body to the impregnating resin. The ultrasonic radiation generally disclosed in Naundorf et al., presumably provides improved resin penetration into the interstices of the fibrous sheet.

While Naundorf et al. and others have suggested the potential of improved resin penetration through the general use of ultrasonic energy, no one appears to have addressed the specific problem of providing thoroughly impregnated high basis weight paper in the treatment of such paper in high-speed treaters, particularly, sheets having a nominal width of about 50 inches travelling at speeds above about 500 ft./min. Kraft papers having a basis weight of up to about 150 lbs./3,000 sq. ft. can be properly treated most of the time in treaters that do not use ultrasonic energy, with problems occurring intermittently but mostly in January and February when colder temperatures raise resin viscosity. Such poor penetration is characterized by varnish coating the surface of the Kraft paper but not thoroughly impregnating it. Laminates made from such poorly impregnated paper have poor blister resistance and are not commercially acceptable.

It should be understood that unless the ultrasonic energy can be designed to solve this specific problem, its use would be counter-productive. The cost of equipment and energy would be wasted if only an immeasurable or minor improvement is obtained. It should also be understood that small scale tests in beakers and laboratory sized equipment cannot be easily translated to effective production solutions at the scale and speeds described.

SUMMARY OF THE INVENTION

The above problems have been solved by utilizing a completely resin bath immersed ultrasonic wave generator, positioned a short distance from the moving sheet surface, in combination with the use of a resin having a viscosity below about 1,000 cps. at 25° C., where the generator is operated at frequency and power levels sufficient to generate a cavitated area or zone in a portion of the bath through which the sheet passes.

More specifically, the moving sheet is passed through a bath of resin having a viscosity, preferably, of from about 10 cps. to about 750 cps. at 25° C., in such a manner that the moving sheet is disposed from about ¼ inch to about 6 inches (0.6 to 15.3 cm.) from the resonant vibrating surface of at least one collimated ultrasonic wave generator. The ultrasonic wave generator will have a frequency over about 10,000 Hz (Hertz), i.e., 10,000 cycles per second, and a preferred frequency range of from about 10,000 Hz to about 35,000 Hz. The resonant vibrating surface(s) of the ultrasonic wave generator(s) should be disposed along a substantial portion of the width of a least one side of the passing sheet, to provide cavitation effect along the width of the porous sheet face.

The radiated power level of the ultrasonic wave generator must be effective to provide a combination of: (1) a direct vibratory pressure effect on the resin molecules; and (2) a cavitation effect comprising cavitation induced resin degassing and microstreaming effect and a resin heating effect on resin in the close vicinity of the passing sheet and the ultrasonic wave generator resonant vibrating surface. The porous paper will pass through a cavitated area or zone in close proximity to the resonant vibrating surface of the ultrasonic wave generator. No induced or direct chemical reaction is caused by the ultrasonic energy.

This method would allow the use of thicker, higher basis weight sheets, i.e. over about 150 lbs/3,000 sq. ft. and over about 10 mils thick, in the impregnation process. This would increase productivity, since fewer sheets of resin-impregnated, thick paper would be needed to fabricate a laminated plate of a specified thickness. This method additionally eliminates almost all air voids, adding appreciably to the electrical insulating characteristics of the cured laminate. This method is commercially feasible and particularly useful for fast through rate, short resin dwell time processes.

BRIEF DESCRIPTION OF THE DRAWING

For a better understanding of the invention, reference may be made to the preferred embodiment exemplary of the invention, shown in the accompanying Drawing, which is a schematic illustration of the continuous impregnation of porous cellulosic sheet material passing through a cavitated zone in a resin bath using the method of this invention.

DESCRIPTION OF THE PREFERRED EMBODIMENTS

Referring now to the Drawing, porous, high basis weight cellulosic sheet material 1, usually having a thickness of from about 10 mils to 25 mils (0.010" to 0.025" or 0.024 cm to 0.064 cm.), is unwound from a reel (not shown) and passed over optional kiss-coat roller 2, the bottom of which is immersed in resin 3 contained within bath walls 4. The roller 2 can be used to initially wet the moving sheet with resin and force some resin into the interstices in the pore volume of the sheet.

The sheet 1 can be any flexible, porous cellulosic material, such as, Kraft paper, cotton linters paper, alpha-cellulose paper, and the like. The sheet travel rate can vary from 3 feet/minute to about 800 feet/minute (0.9 to 243.8 meters/minute). In a commercial operation, the preferred travel rate is from about 350 feet/minute to about 800 feet/minute (106.7 to 243.8 meters/minute), most preferably from about 500 feet/minute to about 800 feet/minute, with a differential length of sheet having a resin bath dwell time of from about 0.2 second to 1 second, preferably from about 0.2 second to about 0.5 second. Such a fast travel rate coupled with the use of maximum density and thickness of sheet add to the economies of the operation. One of the main advantages of this process, is that high basis weight, thick Kraft paper sheets can be completely impregnated at high speeds. And so, basis weights of from about 150 pounds to about 200 pounds (per 3,000 square feet) and corresponding sheet thicknesses of from about 10 mils to about 18 mils to 25 mils can now be easily impregnated.

The organic resin 3, which will have a viscosity of up to about 1,000 cps. at 25° C., preferably from about 10 cps. to about 750 cps. at 25° C., can be selected from phenolic resin, i.e., phenolic-aldehyde resin, such as phenolic-formaldehyde resin; melamine resin, i.e., melamine-aldehyde resin, such as melamine-formaldehyde resin; epoxy resin, such as diglycidyl ethers of bisphenol A, cycloaliphatic epoxy resins, and the like; and polyester resins, all of which are well known in the art. These resins may be dissolved in suitable solvents to provide resin solutions with appropriate viscosities within the range set forth above. Further reference may be made to *Plastics Materials* by J. A. Brydson, 1966, chapters 19 through 22, for a detailed description of these resins. The usual starting temperature of the resin bath will be about 25° C. to 30° C.

Guide rolls 5 can be used to direct sheet travel within close proximity of one or more completely immersed ultrasonic wave generators 6. The ultrasonic wave generator(s) are closely disposed in series along the width of at least one side of the passing sheet, so that the resonant vibrating surface is disposed along a substantial portion of the width of the sheet. The ultrasonic wave generator can be, for example, a transducer utilizing annealed nickel magnetostrictive material, or a composite piezoceramic longitudinal vibrating element, with associated transformers and like equipment. These generators provide a collimated ultrasonic beam, i.e., substantially the same width as the resonant vibrating surface. Thus, if a very wide sheet is to be impregnated, two to five generators may be required to be positioned next to each other across the sheet width, to provide resonating surfaces across the sheet width.

The ultrasonic wave generator has a preferred frequency range of from about 10,000 Hz to about 35,000 Hz. Over 35,000 Hz, the vibrating element is small and requires more input power to reach the cavitation threshold of the liquid resin, causing the efficiency of the process to decrease. Under 10,000 Hz, resonant transducers become large and unwieldly, and such frequencies may pose hearing problems to workers.

Usual input power to the ultrasonic wave generator is between about 300 watts to 2,500 watts. The radiated, output power level from the wave generators used must be effective to pass the minimum watts/sq. in. cavitation threshold of the liquid resin, which will vary with resin viscosity, and cause a cavitation effect in a cavitated zone in close proximity to the resonant vibrating surface of the ultrasonic wave generator(s). The resonating surface of the ultrasonic wave generator is placed from about $\frac{1}{4}$ inch to about 6 inches (0.6 to 15.3 cm.), preferably from about 1 inch to about 4 inches from the moving sheet. At less than about $\frac{1}{4}$ inch or more than about 6 inches, cavitation and the like effects caused by the ultrasonic wave generator will not be effective to substantially improve resin penetration into the sheet.

Optionally, an ultrasonic wave reflector plate 7, such as $\frac{1}{8}$ inch thick stainless steel, can be placed above the passing sheet, within about 6 inches from the resonant vibrating surfaces of the wave generator. This may help improve resin penetration efficiency. Also, one or more additional ultrasonic wave generators can be placed where the reflector plate 7 is shown, so that the sheet passes between ultrasonic wave generators, although this adds to the power requirements and expense of the process.

As can be seen, the cellulosic sheet 1 passes through the resin and then through a cavitated zone 10, shown by dotted lines, in close proximity to the resonant vibrating surface 11, of the ultrasonic wave generator. This cavitated zone will extend out about 6 inches from resonant surface 11 and then start to decay. The cavitated zone will function next to the resonant vibrating surface 11 and a short distance on the other side of the passing sheet. Within this cavitated zone volume, there is an active cavitation effect on the passing sheet.

After exiting the resin bath, the impregnated sheet 8 passes through a pair of nip rollers 9, so that excess resin is squeezed or otherwise removed from the sheet surface. The impregnated sheet then passes through a long drying oven (not shown) to "B"-stage the resin, i.e., dry it to a non-tacky, non blocking state which is still capable of further final cure, after which it is wound on a reel for storage. Sheet from the storage roll can be cut to size and heat and pressure laminated to provide consolidated decorative and industrial laminates, circuit boards, fire resistant plate, and the like.

Some of the mechanisms by which the high-power ultrasonic zone produced by the ultrasonic wave generator can affect the resin medium and the passing web, when the resonant vibrating surface of the wave generator is closely disposed to the passing web and acting on the proper viscosity resin medium, with an effective amount of radiated power, include: (1) direct action of sinusoidal vibratory pressure on the resin molecules; and (2) cavitation induced liquid degassing with associated, localized mechanical and thermal shock due to cavitation, along with microstreaming due to liquid nonlinearity at high intensity levels, and lowered liquid viscosity due to heating. No chemical reactions are caused or induced.

A wave having out-of-phase pressure and velocity distributions is imparted to the resin medium by sinusoidal vibration of the ultrasonic transducer's radiating face. Uniform oscillation of this face transmits an acoustic wave having a particle velocity into the resin. This velocity acts against the impedance of the resin to yield a pressure. When the sound wave is transmitted into a confined space, a standing wave having much greater velocity and pressure amplitudes can be established. So long as a liquid is ultrasonically irradiated at a low power, little observable effects occur. However when the radiated power is increased, it effects bubble formation, i.e., degassing, small foggy bubble streamers, i.e., microstreaming, and other physical cavitation activity within a cavitation zone or area. When resin viscosity is about 10 cps. at 25° C., moderately high ultrasonic radiated power at a frequency of from about 10,000 Hz to about 25,000 Hz will be sufficient to provide cavitation, liquid degassing and microstreaming. When resin viscosity is over about 1,000 cps. at 25° C., it is difficult to induce cavitation, degassing and microstreaming even at very high radiated power levels.

This cavitation effect is essential, in addition to mere vibrator pressure, in providing very quick and thorough impregnation of the passing sheet. The ultrasonic waves are means to achieve cavitation within the cavitated zone, i.e., the formation and bursting of bubbles filled with resin varnish vapor and air vapor trapped in the liquid resin. Cavitation is a phenomenon characterized by production of gas-filled energy storage cavities, during the negative half-cycle of an ultrasonic wave, when the pressure drops to less than the vapor pressure of the liquid, and the rapid implosion of these cavities during the subsequent half-cycle of the wave. While the quantity of energy in any one implosion is extremely small, it is thought that enormous pressures (5,000 psi. to 10,000 psi.) and enormous temperatures (over 3,000° C.) are developed. Cavitation induced degassing, microstreaming and agitation, as well as radiation pressure will improve resin homogeneity and resin wetting ability.

The energy released by the cavitation effect also causes a general resin heating effect, which reduces the viscosity of the resin, allowing better resin flow into the interior pore volume of the passing sheet. Depending on the resin bath volume, over a 2-hour period, resin temperature can be raised from 25° C. to about 33° C., due to cavitation effects. Additionally, the cavitation effect prevents resin cure on the wave generator due to breaking up the thin, stagnant boundary layer which would normally adhere to the surface of a standard immersion heater.

Complete immersion of the wave generator allows close wave generation to the passing sheet and allows any heat due to mechanical vibration within the generator to also be transferred to the resin. The resonant vibrating surfaces of the ultrasonic wave generators must extend across a substantial portion of the width passing sheet to provide a cavitation effect across the porous sheet face. If several wave generators are used in series across the sheet width, there may be a 1 inch to 8 inch gap or break between the in series resonant vibrating surfaces, without materially affecting the cavitation effect across the sheet width. If the sheet width is 50 inches, two 20 inch long wave generator units, having 17 inch vibrating surfaces, could be placed in series, across from each other, across the sheet width, with a gap between vibrating surfaces of about 8 inches, without adversely affecting the cavitation effect.

The proper positioning of the ultrasonic wave generator in relation to the passing sheet, combined with use of a cavitation effecting amount of radiated power, combined with an appropriate wave frequency upon a suitable organic resin, having an appropriate viscosity to allow cavitation, will provide not only a direct vibratory pressure on the resin molecules, but also, and very importantly, degassing accompanied by heating and lowering of the resin viscosity within the cavitation zone, accomplishing efficient, quick, and complete resin impregnation of the passing sheet. The term "cavitation effect" is herein defined as such degassing, i.e., formation and implosion of bubbles, microstreaming, and resin heating hereinbefore described. The term "cavitated zone" is herein defined as the volume within which there is a cavitation effect.

EXAMPLE 1

Two ultrasonic wave generators, having a 20 inch long housing and a 17 inch long vibrating surface, utilizing annealed nickel magnetostrictive material (Westinghouse Model I820 Magnapak Immersible Ultrasonic Transducer), operating at 20,000 Hz and drawing 1,000 watts of electrical input power each, were completely immersed in the resin bath of an experimental, laboratory treater similar to that shown in the Drawing. The treater however did not have an initial kiss-coat roller or reflector plate.

A sheet of 156 lb./(3,000 sq.ft.) basis weight saturating Kraft paper, about 12 mils thick and 12 inches wide, was continuously passed through a phenol-formaldehyde resin bath having a viscosity of 692 cps. at 25° C., and, by means of guide rolls, within 1½ inches of the resonating surface of the transducers. The transducers were placed one above the other on the same side of the passing sheet, and extended along the full width of the passing sheet, so that their vibrating surfaces also extended across the width of the sheet. The transducers were placed between the sheet and the bath wall as shown in the Drawing.

The sheet travel rate was about 30 ft./min. The travel between bath entrance and squeeze rolls, located outside of the bath to remove excess resin from the impregnated sheet, was about 2 feet. Dwell time in the resin bath was about 3 seconds. After passing through the resin bath and through the squeeze rolls, the phenolic impregnated sheet was passed through a 40 foot long hot air oven operating at about 170° C., to "B"-stage the resin, after which it was rolled onto a reel.

Two runs were made to produce two sample reels of impregnated sheet about 0.012" thick. In the first run, the transducers were not turned on and the bath temperature remained essentially constant at 27.9° C. In the second run, the transducers were turned on at 20,000 Hz. In the second run, slight degassing bubbling was observed in the resin in the cavitation zone that the sheet was passing through, as well as a bath temperature increase of 0.14° C./min.

Samples of impregnated sheet from each reel were torn at an angle, as to delaminate a wedge-shaped, cross-section. The phenolic resin was of dark brown color and the Kraft paper was of light tan color, so that visual inspection of the color of the sheet centers provided a good measure of phenolic impregnation.

The first run sheet, made in the process without ultrasonic wave generation, was dark brown on the outside but light tan on the inside. The second run sheet, taken from a section of sheet which had been impregnated about 20 minutes after the ultrasonic wave generator had been turned on, was dark brown on the outside and mostly dark brown on the inside, indicating very good penetration of the fairly viscous phenolic resin into the interior void volume of the Kraft paper sheet, due to cavitation effect as well as vibratory pressure on the resin. A series of both sheets were split with the same results. Thus, although the sheet travel rate was slow, with a fairly long resin dwell time, the resin was of high viscosity, and the impregnation substantially complete.

EXAMPLE 2

Example 1 was repeated in every respect except that a phenol-formaldehyde resin having a viscosity of 951 cps. at 25° C. was used in the bath. Very little degassing bubbling was observed in the resin indicating only a small amount of cavitation. Here, resin penetration using the transducers, which still provided a vibrating effect, was not found to be very much improvement over resin impregnation without using the transducers. Increasing power input to increase the radiated power level would have provided only small improvement.

EXAMPLE 3

Here, the two Westinghouse Model I820 ultrasonic wave generators, with 17 inch long vibrating surfaces and 1,000 watts input, were positioned in the resin bath and across the width of sheet travel of a pilot impregnator, which was a stretched out version of that shown in the Drawing, utilizing an initial kiss-coat roller but no reflector plate. A sheet of 184 lb./(3,000 sq.ft.) basis weight saturating Kraft paper, about 14 mils thick and 50 inches wide, was passed through a phenol-formaldehyde resin bath having a viscosity of 125 cps. at 25° C., into which a black dye had been dispersed, and, by means of guide rolls, within 2½ inches of the resonating surface of the transducers. The transducers were placed next to each other on the same side of the passing sheet, such that their vibrating surfaces were 8 inches apart. The two transducers were centered on a midline 12½ inches in from the edge of the 50 inch wide sheet. The transducers were placed between the sheet and the bath wall as shown in the Drawing.

The sheet travel rate was almost commercial speed, about 350 ft./min., over 10 times faster than in Example 1. The travel between the pre-wet roller at the bath entrance and squeeze rolls located outside of the bath to remove excess resin from the impregnated sheet was about 10 feet. Dwell time in the resin bath was about 0.5 second. After passing through the resin bath and through the squeeze roller, the phenolic impregnated sheet was passed through a five-zone hot air oven operating at from about 115° C. to about 170° C., to "B"-stage the resin, after which it was cut into sheets and stacked into a pile.

Two runs were made to produce two sample stacks of impregnated sheet about 0.014" thick. In the first run, the transducers were not turned on and the bath temperature remained essentially constant at 27.7° C. During this run, the dye started to fall from suspension, producing dye streaks. In the second run, the transducers were turned on at 20,000 Hz. In the second run, major degassing bubbling was observed in the resin in the cavitation zone that the sheet was passing through, as well as a bath temperature increase of 0.05° C./min.

During this run, the dye streaks were eliminated as the dye was apparently redispersed in the resin. Samples of impregnated sheet from each stack were torn at an angle, as to delaminate a wedge-shaped, cross-section. The dyed phenolic resin was of black color and the Kraft paper was of light tan color, so that visual inspection of the color of the sheet centers easily provided a good measure of phenolic impregnation.

The first run sheet, made in the process without ultrasonic wave generation, was black on the outside but light tan on the inside. The second run sheet, taken from a section of sheet which had been impregnated about 20 minutes after the ultrasonic wave generator had been turned on, was black on the outside and mostly black on the inside, indicating excellent and complete penetration of the phenolic resin into the interior void volume of the Kraft paper sheet, due to cavitation effect as well as vibratory pressure on the resin. A series of both sheets were split with the same results.

This Example illustrates the commercial practicality of this process, where fast speed, short resin dwell times, and low viscosity resins are the norm. Sheets impregnated using this method can be increased in thickness over what had heretofore been practical, with no loss of line speed, productivity, or resin impregnation. Other resins, such as epoxies could be easily substituted for the materials described in Examples 1 and 3 with equally outstanding results.

We claim:

1. A method of impregnating a flexible, porous, thick, high basis weight, cellulosic sheet material comprising the steps:

(1) continuously passing a flexible, porous cellulosic sheet material, having a basis weight of over about 150 lbs./3,000 sq. ft. and a thickness of over about 10 mils, at a rate of speed of from about 350 feet/-minute to about 800 feet/minute, through a bath of liquid, organic, "B"-stageable impregnating resin, having a viscosity of from about 10 cps. to about 750 cps. at 25° C., and through a cavitated zone in close proximity to the resonant vibrating surface of at least one ultrasonic wave generator, said cellulosic sheet material passing from about ¼ inch to about 6 inches away from the surface of the ultrasonic wave generator, where a differential length of the cellulosic sheet has a dwell time in the resin bath of from about 0.2 second to about 1 second, said ultrasonic wave generator being completely immersed in the resin and operating at a frequency of over about 10,000 Hz and at a radiated power level effective to provide a combination vibratory pressure on the resin molecules, and cavitation effect causing degassing and microstreaming of the resin, and heating of the resin within the cavitated zone along the width of the passing sheet, said heating causing a lowering of the resin viscosity, said combination of vibratory pressure and cavitation degassing and microstreaming effect causing resin impregnation throughout the void volume of the cellulosic sheet; and (2) passing the resin impregnated sheet through a drying means to "B"-stage the resin.

2. The method of claim 1, wherein, as an initial step, the porous sheet material is passed over a contacting roller means containing the bath impregnating resin to provide an initial resin wetting of the sheet, and where the ultrasonic wave generator operates at a frequency of from about 10,000 Hz to about 35,000 Hz.

3. The method of claim 1, where the cavitation effect within the cavitated zone in step (1), causes formation and bursting of bubbles filled with vapor trapped in the liquid resin, causing heating, and where the resonant vibrating surface of the ultrasonic wave generator is disposed along a substantial portion of the width of at least one side of the passing sheet.

4. The method of claim 1, where the sheet passes between ultrasonic wave generators.

5. The method of claim 1, where the sheet passes between an ultrasonic wave generator and an ultrasonic wave reflector plate.

6. The method of claim 1, where the porous sheet material is selected from the group consisting of Kraft paper, cotton linters paper, and alpha-cellulose paper, the sheet material has a basis weight of from about 150 lbs./3,000 sq. ft. to about 200 lbs./3,000 sq. ft., the resin is selected from the group consisting of phenolic resin, melamine resin, epoxy resin and polyester resin, the ultrasonic wave generator operates at a frequency of from about 10,000 Hz to about 35,000 Hz, after step (1) the impregnated sheet is passed through a means to remove excess resin from the sheet surface, and where the travel rate of speed of the sheet is from about 500 feet/minute to about 800 feet/minute.

* * * * *